US011328549B1

(12) United States Patent
Wange et al.

(10) Patent No.: US 11,328,549 B1
(45) Date of Patent: May 10, 2022

(54) ENABLEMENT OF VOTING BY CONTROLLED-ENVIRONMENT FACILITY RESIDENTS

(71) Applicant: Securus Technologies, LLC, Carrollton, TX (US)

(72) Inventors: John Wange, Dallas, TX (US); Dionisia Ray, Dallas, TX (US); Sean North, Allen, TX (US); Connor Pickens, Little Elm, TX (US)

(73) Assignee: Securas Technologies, LLC, Carrollton, TX (US)

( * ) Notice: Subject to any disclaimer, the term of this patent is extended or adjusted under 35 U.S.C. 154(b) by 0 days.

(21) Appl. No.: 17/133,046

(22) Filed: Dec. 23, 2020

(51) Int. Cl.
*G07C 13/00* (2006.01)

(52) U.S. Cl.
CPC ..... *G07C 13/005* (2013.01)

(58) Field of Classification Search
CPC ..... G07C 13/005
See application file for complete search history.

(56) References Cited

U.S. PATENT DOCUMENTS 7,860,222 B1 * 12/2010 Sidler ..... H04L 63/302 379/32.01
2015/0363586 A1 * 12/2015 Klevan ..... G06F 21/32 726/19

* cited by examiner

*Primary Examiner* — Seung H Lee
(74) *Attorney, Agent, or Firm* — Fogarty LLP

(57) ABSTRACT

In embodiments of systems and methods for enabling voting by a controlled-environment (e.g., correctional) facility resident (e.g., incarcerated individual), a controlled-environment facility management system, or the like, may determine federal, state and/or local laws and/or rules concerning the resident's legal right to vote and determine whether the resident is registered to vote in a jurisdiction in which the resident is deemed to reside, with respect to the resident's right to vote in the jurisdiction. In response to a determination that the resident is not registered to vote in that jurisdiction, the facility management system, or the like, may provide documents required for the resident to register to vote, to the resident, for completion and/or execution. The facility management system, or the like, may file, in the jurisdiction in which the resident is deemed to reside, resident-executed documents required for the resident to register to vote.

21 Claims, 3 Drawing Sheets

ENABLEMENT OF VOTING BY CONTROLLED-ENVIRONMENT FACILITY RESIDENTS

TECHNICAL FIELD

The present disclosure relates generally to controlled-environment facility residents, more particularly to enfranchisement of controlled-environment facility residents, and specifically to facilitation and enablement of voting by controlled-environment facility residents.

BACKGROUND

Prisoner voting rights are defined by individual states, and the laws are different from state to state. Some states allow only individuals on probation to vote. Others allow individuals on parole and probation. With a few exceptions, most U.S. states prohibit felons from voting while they are in prison. However, some do, and other states are considering legislation and/or state constitutional amendments to allow such voting. Further, incarcerated individuals convicted of only misdemeanors, or individuals detained and charged, but not yet convicted of a crime (e.g., incarcerated in a county or city jail) typically have the right to vote.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The present invention is directed to systems and methods which enable voting by controlled-environment (e.g., correctional) facility residents (e.g., incarcerated individuals). Therein, a controlled-environment facility resident communication and/or media device may request and accept identification information from a controlled-environment facility resident operating the device. The device may then verify, such as in conjunction with at least a controlled-environment facility management system associated with a controlled-environment facility housing the resident, the identification information. The controlled-environment facility management system, or the like, may determine federal, state and/or local laws and/or rules concerning the resident's legal right to vote and determine whether the resident is registered to vote in a jurisdiction in which the resident is deemed to reside, with respect to the resident's right to vote in the jurisdiction. In implementations where the controlled-environment facility is a correctional facility (e.g., prison) and the resident is a (convicted) incarcerated individual of the correctional facility, the federal, state and/or local laws and/or rules concerning the resident's legal right to vote may pertain to the rights of incarcerated individuals, and/or the particular incarcerated individual in question) to vote.

In response to a determination that the resident is not registered to vote in the jurisdiction in which the resident is deemed to reside, the controlled-environment facility management system, or the like, may provide documents required for the resident to register to vote, to the resident, for completion and/or execution. To carry such out, the controlled-environment facility management system may request, in response to the determination that the resident is not registered to vote in the jurisdiction in which the resident is deemed to reside, the documents required for the resident to register to vote, from the jurisdiction in which the resident is deemed to reside. This request may be made electronically. The documents required for the resident to register to vote may be provided to the resident, by the controlled-environment facility management system, electronically, via a controlled-environment facility resident communication and/or media device. The controlled-environment facility management system, or the like, may, at least partially, complete the documents required for the resident to register to vote, to include, for example, at least the name of the resident, any required identification information, the address of the controlled-environment facility as the address of the resident, and/or the like. Also, the controlled-environment facility management system, or the like may enable the resident, via at least the controlled-environment facility resident communication and/or media device, or the like, to obtain a form of identification and/or identification information required by law and/or rules to register to vote in the jurisdiction in which the resident is determined to reside. The controlled-environment facility management system, or the like, may file, in the jurisdiction in which the resident is deemed to reside, resident-executed documents required for the resident to register to vote.

The controlled-environment facility management system, or the like, may receive an (electronic) ballot for the resident to vote and deliver the (electronic) ballot to the resident, such as via the controlled-environment facility resident communication and/or media device, for voting. The controlled-environment facility resident communication and/or media device may present the electronic ballot to the resident for voting, and (electronically) cast the ballot, after the ballot is executed by the resident, to the resident's jurisdiction of residency, in accordance with the laws and/or rules of the resident's jurisdiction of residency.

In some implementations, upon receipt of a paper ballot for the resident to vote, the controlled-environment facility management system, or the like, may direct delivery of the paper ballot to the resident, and direct casting of the paper ballot, after the paper ballot is executed by the resident, in the resident's jurisdiction of residency, in accordance with the laws and/or rules of the resident's jurisdiction of residency In various embodiments, one or more of the techniques described herein may be performed by one or more computer systems. In other various embodiments, a tangible computer-readable storage medium may have program instructions stored thereon that, upon execution by one or more computer systems, cause the one or more computer systems to execute one or more operations disclosed herein. In yet other various embodiments, one or more systems may each include at least one processor and memory coupled to the processor(s), wherein the memory is configured to store program instructions executable by the processor(s) to cause the system(s) to execute one or more operations disclosed herein.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Figure 1:
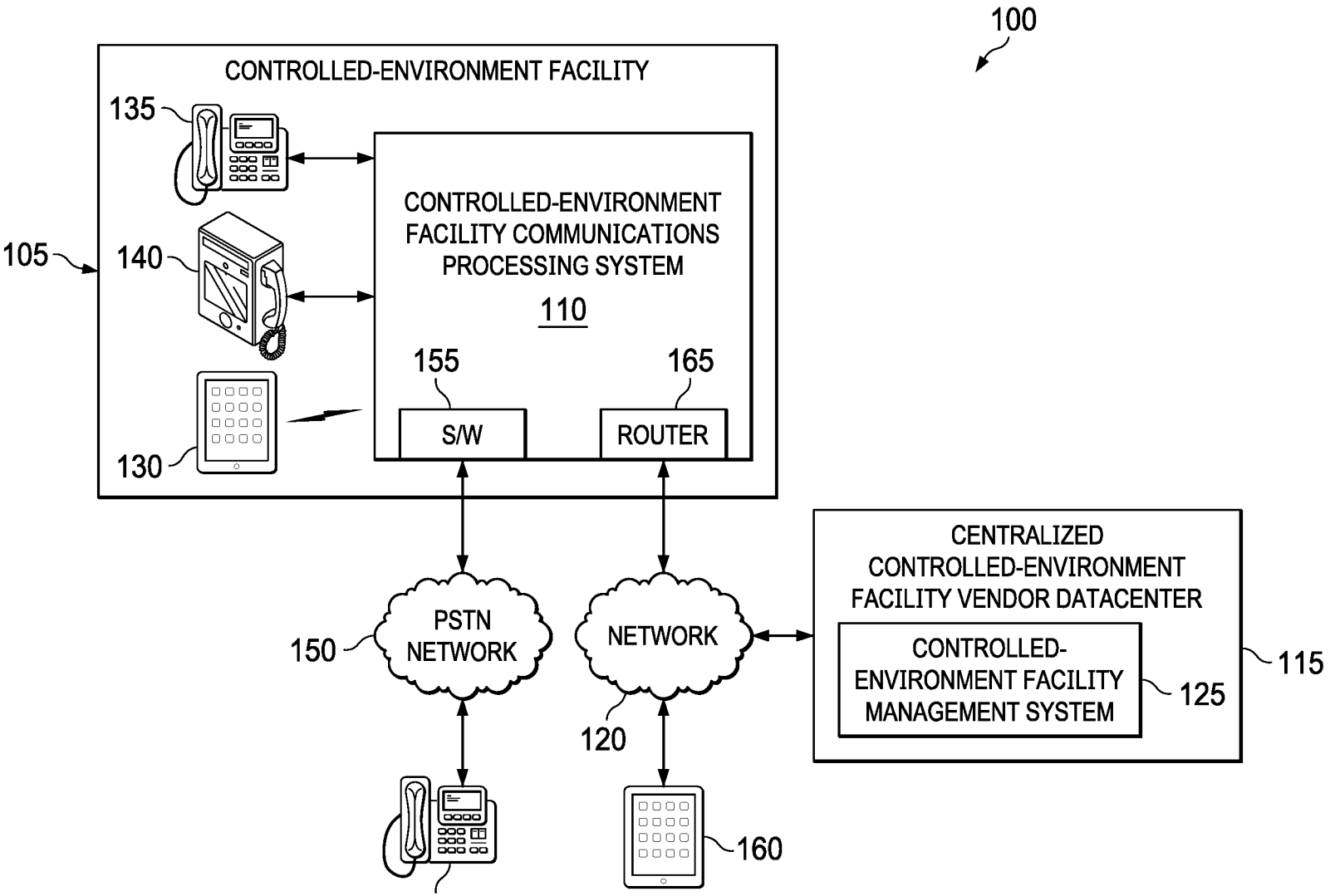
Figure 2:
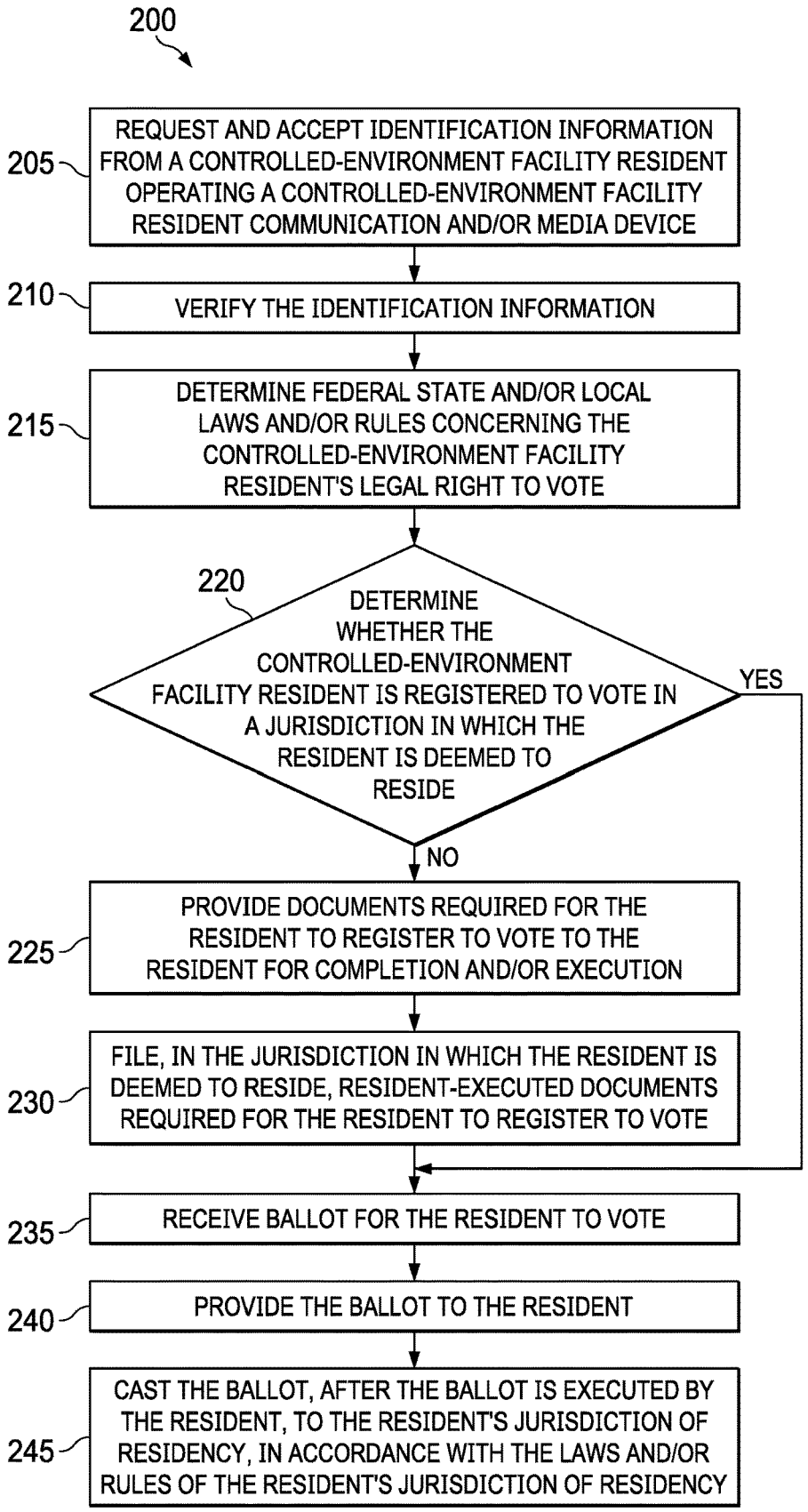
Figure 3:
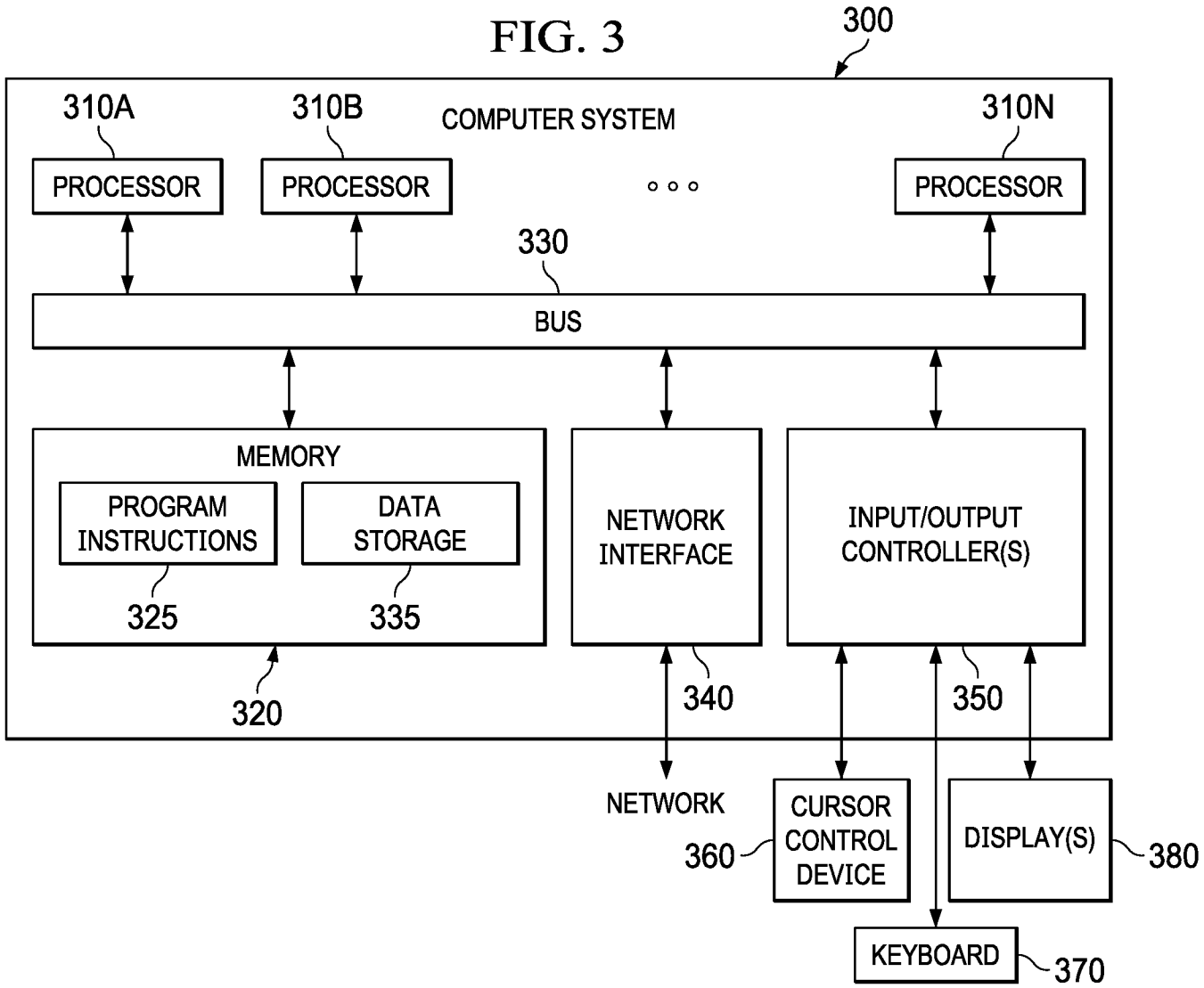

Having thus described the invention in general terms, reference will now be made to the accompanying drawings, which are not necessarily drawn to scale, and wherein:

FIG. 1 is a diagrammatic illustration of an example controlled-environment, wherein an example embodiment of the present systems and methods for enablement of voting by controlled-environment facility residents may be practiced, in accordance with some embodiments;

FIG. 2 is a flowchart of an example process for enabling voting by controlled-environment facility residents, in accordance with some embodiments;

FIG. 3 is a block diagram of a computer system, device, station, or terminal configured to implement various techniques disclosed herein, according to some embodiments.

While this specification provides several embodiments and illustrative drawings, a person of ordinary skill in the art will recognize that the present specification is not limited only to the embodiments or drawings described. It should be understood that the drawings and detailed description are not intended to limit the specification to the particular form disclosed, but, on the contrary, the intention is to cover all modifications, equivalents and alternatives falling within the spirit and scope of the claims. Also, any headings used herein are for organizational purposes only and are not intended to limit the scope of the description. As used herein, the word "may" is meant to convey a permissive sense (i.e., meaning "having the potential to"), rather than a mandatory sense (i.e., meaning "must"). Similarly, the words "include," "including," and "includes" mean "including, but not limited to."

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

For example, various types of controlled-environment facilities are present in today's society, and persons may be voluntary or involuntary residents of such facilities, whether temporarily or permanently. Examples of controlled-environment facilities may include correctional institutions (e.g., municipal jails, county jails, state prisons, federal prisons, military stockades, juvenile facilities, detention camps, home incarceration environments, etc.), healthcare facilities (e.g., hospitals, nursing homes, mental health facilities, rehabilitation facilities, such as drug and alcohol rehabilitation facilities, etc.), restricted living quarters (e.g., hotels, resorts, camps, dormitories, barracks, etc.), and the like. For convenience of explanation, various examples discussed herein are presented in the context of correctional facilities, or the like. For instance, in some of the embodiments discussed below, a controlled-environment facility may be referred to as a correctional facility, jail or prison, and its residents may be referred to as incarcerated individuals, arrestees, or detainees. It should be understood, however, that the systems and methods described herein may be similarly applicable to other types of controlled-environment facilities and their respective residents (e.g., a hospital and its patients, a school dormitory and its students, etc.).

As used herein, the word "resident" generally refers to a person residing, incarcerated, detained, etc. in a controlled-environment facility. Whereas, the term "residency" and phrases referring to a jurisdiction such as where the resident "resides" refer to the legal residency of such a resident, this may also be referred to as the "permanent address," "legal residence," or the like, of the controlled-environment facility resident.

Embodiments of the present systems and methods are generally related to controlled-environment facilities and their residents, more particularly to enfranchisement of controlled-environment facility residents, and specifically to facilitation and enablement of voting by controlled-environment facility residents, such as correctional facility incarcerated individuals and especially unconvicted detainees. In embodiments of the present systems and methods for enabling voting by a controlled-environment (e.g., correctional) facility resident (e.g., incarcerated individual), a controlled-environment facility management system, or the like, may determine federal, state and/or local laws and/or rules concerning the resident's legal right to vote and determine whether the resident is registered to vote in a jurisdiction in which the resident is deemed to reside, with respect to the resident's right to vote in the jurisdiction. In response to a determination that the resident is not registered to vote in that jurisdiction, the facility management system, or the like, may provide documents required for the resident to register to vote, to the resident, for completion and/or execution. The facility management system, or the like, may file, in the jurisdiction in which the resident is deemed to reside, resident-executed documents required for the resident to register to vote.

FIG. 1 is a diagrammatic illustration of example controlled-environment 100, wherein an example embodiment of the present systems and methods for enablement of voting by residents of controlled-environment facility 105 may be practiced, in accordance with some embodiments. In environment 100, controlled-environment facility communication processing system 110 may provide telephone services, videoconferencing, online chat, internet connectivity and other communication services to residents of controlled-environment facility 105. In some cases, such as illustrated, controlled-environment facility communication processing system 110 may be co-located with controlled-environment facility 105. Alternatively, or additionally, an external centralized communications processing system may be deployed in a controlled-environment facility vendor (e.g. a controlled-environment facility communications provider) datacenter 115, call center, or the like. That is, controlled-environment facility communication processing system 110 may be centrally and/or remotely located with respect to one or more controlled-environment facilities and/or may provide communication services to multiple controlled-environment facilities, in which case, controlled-environment facility 105 is illustrated as one example. Such a controlled-environment facility vendor datacenter may be connected to such facilities via a public network (e.g. the Internet) 120 or a private network (e.g. intranet), or the like (e.g., via a secure tunneling protocol over the internet, using encapsulation). More generally, however, it should be noted that controlled-environment facility communication system 110 may assume a variety of forms, including telephony switches such as electronic switching systems, or the like, and/or and may be configured to serve a variety of facilities and/or users, whether within or outside of a controlled-environment facility.

Controlled-environment facility management system 125 of controlled-environment facility vendor datacenter 115, which may include or be associated with (a separate) controlled-environment facility resident account management system, or the like, may maintain resident identification information, which may be stored in a separate database associated and/or controlled with controlled environment facility 105, such as a controlled-environment facility administration and management system database. In a correctional environment, such a controlled-environment facility management system (125) may be referred to as a jail management system (JMS). Controlled-environment facility management system 125 and/or the associated or included controlled-environment facility resident account management system, may maintain resident (trust) accounts to the benefit of the respective resident, such as resident commissary accounts, resident communications accounts, which may be used to pay for purchase of a personal controlled-environment facility resident communication and/or media device (130), personal controlled-environment facility resident communication and/or media device accessories (headphones, wearables, etc.), communications (such as phone calls, video visitation, internet chats, emails, text messages), and/or the like.

Residents may use more-or-less conventional telephones 135 to access certain communication services. However, in accordance with embodiments of the present systems and methods, residents may also use a controlled-environment facility resident communication and/or media device 130, communal controlled-environment facility resident communication and/or media terminals 140 or the like, For example, personal computer wireless devices, such as a tablet computing device or smartphone (130), which may have been adapted and/or approved for use in controlled-environment facility, may be used by controlled-environment facility residents for communication. Such a personal resident device may be referred to as a "personal controlled-environment facility resident communication and/or media device," an Intelligent Resident Device (IRD), or the like, in controlled-environment facilities, in general. These may also be referred to as an "incarcerated individual personal communications and/or media device," an Intelligent Incarcerated Individual Device (IID), or the like, in a correctional institution environment.

As noted, additionally, or alternatively, a resident may use a "communal controlled-environment facility resident communication and/or media terminal" 140, or the like, to place voice calls, as well as for video communication, execution of other application programs (apps), including media apps, game apps, job search apps, etc. Such a controlled-environment facility video communication terminal may be referred to as an Intelligent Facility Device (IFD), which may be a video phone particularly adapted for use in a controlled-environment facility. Generally speaking, multiple controlled-environment facility resident communal communication and/or media terminals/IFDs 140 are disposed in a controlled-environment facility, and may be disposed in a visitation room, in a pod, as part of a kiosk, as an alternative to a controlled-environment facility communication kiosk, etc. As will be appreciated, IRD 130, IFD 140, or other similar devices have video conferencing capabilities, or the like, to enable a party to participate in video communication sessions with other call parties, such as non-residents of the controlled-environment facility, via video communication, secure online chat, etc. In some cases, IFD 140 may assume the form of any computer, tablet computer, smart phone, etc., or any other consumer device or appliance with videoconferencing capabilities. For example, in a correctional facility environment a tablet computing device (e.g., an IRD 130) may be mounted on a wall, in a hardened case, as a controlled-environment facility resident communal communication and/or media terminal or IFD (140). IFD 140 may also take the form of a docking station adapted to support and interface with an IRD 130 to provide communication, data, or other services.

Personal controlled-environment facility resident communication and/or media devices, IRDs 130, may be tablet computing devices, smartphones, media players, smart watches, or the like adapted and/or approved for use by residents of the controlled-environment facility (within the controlled-environment facility). Each IRD 130 may be particularly adapted for use in a controlled environment. For example, in a correctional institution, jail, or the like, such an IRD, or IID, may have a specifically adapted operating system and/or may be "stripped-down," particularly from the standpoint of what apps and/or hardware are provided or allowed on IRD 130, and/or connectivity afforded such an IRD. For example, such an IRD may employ an operating system kernel built for use in such an IRD in a controlled-environment facility. As a further example, the IRD may be adapted to only connect to a network provided by the controlled-environment facility, and/or in only certain locations, within the controlled-environment facility, such as may be controlled by availability of Wi-Fi access, or the like, only being available in certain areas. That is, for example, where streaming and/or downloading may be compartmentalized, leveraging the (concrete and steel) structure (i.e. construction, layout, etc.) of the controlled-environment facility, for example, limiting the availability of a Wi-Fi signal, providing the stream through the placement of wireless access points, antenna directionality of such wireless access points, and/or the like. Further, the IRD may allow access to apps or content only upon application of security measures, by the IRD. Such security measures may include determining, by the IRD, DNS spoofing, DNS redirection, use of proxy servers for privacy and security, biometric validation, password validation, and/or the like. Also, in accordance with embodiments of the present systems and methods, the IRD may have a few fixed apps pre-installed on the device, and installation of further apps on the device may be forbidden (i.e. prevented by modifications to the device's operating system, or the like) and/or restricted, such as by requiring permission from a facility administrator, or the like. Apps provided on IRDs might include apps of particular interest to residents of the controlled-environment facility. For example, IRDs provided to incarcerated individuals of correctional facilities, might include apps that may be of particular use to an incarcerated individual, in general, such as access to a legal research service, or of more specific interest, such as providing an incarcerated individual nearing release, access to employment searching apps or the like. Hence, such incarcerated individual IRDs may be used to help soon to be released incarcerated individuals transition. For example, the IRD may be used to communicate with a future employer, or the like. As such, IRDs may be sponsored, or otherwise subsidized by organizations or companies, assisting with the transition of incarcerated individuals into society, or the like.

While such personal controlled-environment facility resident communication and/or media devices, IRDs, IIDs, incarcerated individual personal communications and/or media devices (generally, 130), communal controlled-environment facility resident communication and/or media terminals (140) or the like, may be used to practice embodiments of the present systems and methods. Such personal controlled-environment facility resident communication and/or media devices, IRDs, IIDs, incarcerated individual personal communications and/or media devices (generally, 130), communal controlled-environment facility resident communication and/or media terminals (140), or the like, may be referred to generally (herein), individually or collectively as "controlled-environment facility resident communication and/or media device(s)."

In various embodiments, to access voice (or video) communication services, a resident may initiate approved telephone services by lifting the receiver on telephone 135 or IFD 140, and/or otherwise initiating a call, such as by launching a communications app on IRD 130 (or IFD 140). At which time, the resident may be prompted to provide a personal identification number (PIN), other identifying information and/or biometrics. An Interactive Voice Response (IVR) unit (not shown, but which may be integrated into controlled-environment facility communication processing system 110) may generate and play a prompt, or other messages, to the resident on device 130, 135 or 140. Under the control of controlled-environment facility communication processing system 110, devices 130, 135 or 140 may be capable of connecting to a non-resident's (i.e., a person not incarcerated or otherwise committed to a controlled-environment facility) telephone 145 across a Publicly Switched Telephone Network (PSTN) 150. For example, telephone 145 may be located at a non-resident's home or office, at a resident visitation center, etc. Telephony switch 155, in controlled-environment facility communication processing system 110, may be used to connect calls across PSTN 150. Additionally or alternatively, the non-resident may communicate using device 160, which may be a mobile phone, tablet computing device, personal computer, or the like, which may be connected through an Integrated Services Digital Network (ISDN), Voice-over-IP (VoIP), or packet data network (such as, for example the Internet), a wireless communications network, or the like 120. Telephony router 165 of controlled-environment facility communication processing system 110 is used to route data packets associated with a call connection to device 160. For example, a non-resident party may have a device 160 with a built-in front-facing camera, or the like, and an integrated display (e.g., a smart phone, tablet, etc., as illustrated), a personal computer with a webcam, etc. A network connection between the parties may be established and supported by an organization or commercial service that provides computer services and software for use in telecommunications and/or VoIP, such as SKYPE®. Additionally, or alternatively, the correctional facility and/or the destination may use videoconferencing equipment compatible with ITU H.323, H.320, H.264, and/or V.80, or other suitable standards.

In addition to providing certain visitation and communication operations, controlled-environment facility communication processing system 110 may attempt to ensure that a resident's calls, video conferences, online chats, etc. are performed only with non-residents whose identities, devices, email addresses, phone numbers, etc. are listed in that resident's Pre-Approved Contact (PAC) and/or Pre-Approved Number (PAN) list. Each resident's PAC and/or PAN list(s) may be stored, for example, in (a) database(s) maintained by controlled-environment facility vendor datacenter 115 (such as by controlled-environment facility management system 125, or the like), and/or the like. In addition to PAC and/or PAN list(s), controlled-environment facility vendor datacenter 115 (e.g., controlled-environment facility management system 125), and/or the like, may also store Resident Profile Data (RPD), as well as communication and/or visitation rules applicable to each resident. This, or another, controlled-environment facility vendor datacenter 115 (controlled-environment facility management system, controlled-environment facility resident account management system, and/or the like) database(s) may include information such as balances for resident trust and calling accounts; trial schedule; conviction data; criminal record; sentencing data, such as time served, time remaining to be served, and release date; cell and cellmate assignments; resident restrictions and warnings; commissary order history; telephone call history; call recordings; known or suspected gang or criminal affiliations; known or suspected affiliates, accomplices, or gang members; and any other information that may be relevant or useful to correctional facility staff to house and maintain residents. In some implementations, controlled-environment facility communication processing system 110 may be configured to perform communication monitoring operations, such being configured to monitor and/or record communication sessions (e.g., as electronic video files).

Computer-based environment components of embodiments of the present systems and methods may include programing and/or hardware to implement such embodiments. This programming may take the form of stored program instructions, programed firmware, or the like, while hardware might take the form of an Application Specific Integrated Circuit (ASIC), or the like, to carry out such aspects of embodiments of the present systems and methods. Thus, in accordance with embodiments of the present systems and methods, a controlled-environment communication and/or media device, IRD 130, IFD 140, or the like may, as discussed in greater detail below, employ at least one processor and a memory coupled to the processor(s). This memory may, for example, be configured to store program instructions executable by the processor(s). These program instructions may include an operating system for controlled-environment resident communication and/or media device 130 or 140 and a controlled-environment facility resident-user interface program or application that includes program instructions executable by the processor(s). This controlled-environment facility resident-user interface may run on top of, and/or as part of, the operating system of the device. This interface may act as a resident communications platform, and also or alternatively, provide (automated) login for interface apps, etc.

In accordance with embodiments of the present systems and methods, the controlled-environment facility resident-user interface may request and accept identification information (e.g., a resident's/incarcerated individual's ID number, biometric information from the resident, a PIN, or the like) from a controlled-environment facility resident operating controlled-environment resident communication and/or media device 130 or 140. For example, a user may be prompted to provide a PIN, biometrics (e.g., facial recognition, fingerprints, finger geometry, iris recognition, vein recognition, retina scanning, voice recognition, or DNA matching) and/or other identifying information to access controlled-environment resident communication and/or media device 130 or 140, and/or to take certain steps in voting and/or registering to vote in accordance with the present systems and methods. Controlled-environment resident communication and/or media device 130, 140, such as in some embodiments in conjunction with controlled-environment facility communication processing system 110, controlled-environment facility management system 125 and/or controlled-environment facility resident account management system 135 verify the identification information. The controlled-environment facility resident-user interface may then, such as, as part of presenting apps available for use by the resident/incarcerated individual-user of controlled-environment resident communication and/or media device (130 or 140), present a controlled-environment facility resident an interface whereby the resident may request or otherwise receive a ballot to vote.

Thereby, in operation in accordance with embodiments of the present systems and methods, for enfranchisement of, that is enabling voting by, a controlled-environment facility resident controlled-environment facility management system 125, or the like may determine federal, state and/or local laws and/or rules concerning the resident's legal right to vote. For example, in embodiments where the resident is a correctional facility incarcerated individual convicted of a crime, a determination may be made, such as by controlled-environment facility management system 125, or the like, whether the voting jurisdiction applicable to the resident allows incarcerated convicts to vote, allows incarcerated individuals (only) convicted of a misdemeanor to vote, or the like. Where the resident is a detainee of a correctional facility (e.g. a (county or city) jail, merely charged with a crime (not yet convicted) the resident may be allowed to vote, absentee, by mail, or the like.

If the resident in question is allowed to vote, controlled-environment facility management system 125, or the like may also determine whether the resident is registered to vote, such as registered to vote in a jurisdiction in which the resident is deemed to reside. That is, the controlled-environment facility management system 125, or the like may (first) determine residency, or the like of the resident, with respect to any existing legal right by the resident to vote in a jurisdiction in which the controlled-environment facility exists, in a jurisdiction other than the jurisdiction in which the controlled-environment facility exists (such as a jurisdiction where the resident resided before becoming a resident of the controlled-environment facility, or the like), etc. Controlled-environment facility management system 125, or the like, may, in response to the determination that the resident is not registered to vote in the jurisdiction in which the resident is deemed to reside, request, the documents required for the resident to register to vote from the jurisdiction in which the resident is deemed to reside, if necessary. Controlled-environment facility management system 125, or the like may request the documents required for the resident to register to vote electronically.

In any case, controlled-environment facility 105, controlled-environment facility management system 125, and/or the like, may provide documents required (i.e., required by federal, state and/or local laws and/or rules) to the resident for completion and/or execution for the resident to register to vote in the jurisdiction in which the resident is deemed to reside, in response to the determination that the resident is not registered to vote in the jurisdiction in which the resident is deemed to reside. In various embodiments of the present systems and methods, the documents required for the resident to register to vote are provided to the resident, such as by controlled-environment facility management system 125, or the like, electronically, via controlled-environment facility resident communication and/or media device 130, such as in an email, via a controlled-environment facility resident forms, etc., particularly where the documents required for the resident to register to vote were requested and/or obtained by the controlled-environment facility management system, or the like, electronically.

In furtherance of embodiments of the present systems and methods controlled-environment facility management system 125, or the like, may, complete a portion of the documents required (by federal, state and/or local laws and/or rules) for the resident to register to vote in the jurisdiction in which the resident is deemed to reside to include, for example, the name of the resident, any required identification information (e.g., social security number, state issued identification number, or the like) of the resident, and/or address information. The address of the controlled-environment facility may be included as the address of the resident, or an address other than the controlled-environment facility may be indicated as the residence address of the resident for purposes of registering to vote (however, the controlled-environment facility may be listed as the mailing address of the resident). In further accordance with embodiments of the present systems and methods the controlled-environment facility management system, or the like may enable the resident, via at least controlled-environment facility resident communication and/or media device 130, to obtain a form of identification and/or identification information required by law and/or rule to register to vote in the jurisdiction in which the resident is determined to reside.

To further enable registration of the resident to vote, controlled-environment facility management system 125, or the like may file resident-executed documents required in the jurisdiction in which the resident is deemed to reside. Once the resident is registered to vote, or otherwise deemed to be registered to vote, the controlled-environment facility may receive a ballot for the resident to vote and deliver the ballot to the resident for voting (i.e., execution and/or filling out of the ballot and/or any related documents, such as a ballot sleeve, ballot return envelope, or the like). Thereafter, the controlled-environment facility may mail, deliver, or otherwise cast, the ballot, with the resident's jurisdiction of residency, in accordance with the laws and/or rules of the resident's jurisdiction of residency. In furtherance of receipt and voting of the resident's ballot, in various embodiments of the present systems and methods controlled-environment facility management system 125, or the like may receive an electronic copy of a ballot for the resident to vote. This electronic copy may be received directly from the jurisdiction in which the resident is considered to reside for purposes of voting, However, in some embodiments, the resident's controlled-environment facility may receive a ballot from the jurisdiction in which the resident is considered to reside for purposes of voting, and the ballot may be scanned and transmitted to the controlled-environment facility management system 125, or the like. In any case, such an electronic (copy of the) ballot may be delivered to the resident, such as, in accordance with embodiments of the present systems and methods, via controlled-environment facility resident communication and/or media device 130, for voting (i.e., execution and/or filling out of the ballot). In accordance with such embodiments, controlled-environment facility resident communication and/or media device 130 then presents the electronic copy of the ballot to the resident for voting (i.e., execution and/or filling out of the ballot).

The controlled-environment facility resident communication and/or media device electronically casts (i.e., delivers) the ballot, after the ballot is completed (i.e., executed and/or filed out) by the resident, to the resident's jurisdiction of residency, in accordance with the laws and/or rules of the resident's jurisdiction of residency. Alternatively, upon receipt of a paper ballot for the resident to vote, controlled-environment facility management system 125, or the like, may direct delivery of the paper ballot to the resident, and direct casting of the paper ballot, after the paper ballot is executed by the resident, in the resident's jurisdiction of residency, in accordance with the laws and/or rules of the resident's jurisdiction of residency. However, in accordance with various embodiments of the present systems and methods, controlled-environment facility management system 125, or the like, may determine if a completed ballot needs to be returned to the resident/incarcerated individual for clarification, signature verification, or the like, the controlled-environment facility management system, or the like may return, or direct return, of the ballot to the resident/incarcerated individual for clarification, signature verification, or the like, or otherwise rectified based on the rules/regulations of the jurisdiction.

FIG. 2 is a flowchart of example process 200 for enabling voting by (i.e., enfranchisement of) controlled-environment facility residents, in accordance with some embodiments. Therein, at 205, a controlled-environment facility resident communication and/or media device (130 or 140) requests and accepts identification information from a controlled-environment facility resident operating the controlled-environment facility resident communication and/or media device. This identification information may include, by way of example a PIN, biometrics (e.g., facial recognition, fingerprints, finger geometry, iris recognition, vein recognition, retina scanning, voice recognition, or DNA matching) and/or other identifying information to access the controlled-environment resident communication and/or media device, and/or to take certain steps, such as described below, in voting and/or registering to vote in accordance with the present systems and methods. At 210, a controlled-environment facility management system (125) associated with a controlled-environment facility (105) housing a particular resident may, such as in conjunction with the controlled-environment facility resident communication and/or media device, verify the identification information. The controlled-environment facility management system may be associated with the controlled-environment facility housing the particular resident, in that it is maintained by a vendor providing services, such as communication services, to the controlled-environment facility, via, by way of example a controlled-environment facility vendor datacenter (115).

The controlled-environment facility management system may, upon verification of the resident-user's identity at 210, determine, at 215, federal, state and/or local laws and/or rules concerning the residents' legal right to vote. For example, determining federal, state and/or local law and/or rules concerning the particular resident's right to vote at 215 may include determining (legal) residency, or the like, of the residents, with respect to any existing legal right by the resident right to vote in a jurisdiction in which the controlled-environment facility exists. Alternatively (or additionally), determining federal, state and/or local law and/or rules concerning the particular residents' right to vote at 215 may include determining (legal) residency, or the like, of the resident, with respect to any right by the resident right to vote in a jurisdiction other than the jurisdiction in which the controlled-environment facility exists, such as in a jurisdiction in which the resident lived, prior to becoming a resident of the controlled-environment facility.

Thereafter, concurrent therewith, or before, the controlled-environment facility management system, or the like, may, at 220, determine whether the resident is registered to vote in a jurisdiction in which the resident is deemed to reside, with respect to any right by the resident to vote in the jurisdiction (as determined at 215). In response to a determination at 220 that the resident is not registered to vote in the jurisdiction in which the resident is deemed to reside, the controlled-environment facility management system, or the like, may, at 225 provide documents required (by federal, state and/or local laws and/or rules) for the resident to register to vote in the jurisdiction in which the resident is deemed to reside to the resident for completion and/or execution. As part of this provisioning of registration documents to the resident at 225, the controlled-environment facility management system may first (electronically) request the documents required for the resident to register to vote in the jurisdiction in which the resident is deemed to reside in response to a determination at 220 that the resident is not registered to vote in the jurisdiction in which the resident is deemed to reside.

At 230, the controlled-environment facility management system, or the like files the documents required (by federal, state and/or local laws and/or rules) for the resident to register to vote in the resident's jurisdiction of residency upon the resident's completion of the documents.

Thereafter, or in response to a determination at 220 that the resident is registered to vote, the controlled-environment facility receives a ballot for the resident to vote, at 235 and provides it to the resident at 240 for voting (i.e., execution and/or filling out). At 245, the controlled-environment facility delivers, mails, or otherwise casts, the residents' executed ballot, once the ballot is completed (i.e., executed and/or filled out) by the resident, to the resident's jurisdiction of residency, in accordance with the laws and/or rules of the resident's jurisdiction of residency.

Also, the documents required for the resident to register to vote may be provided to the resident at 225, by the controlled-environment facility management system, or the like, electronically, such as in an email, via a controlled-environment facility resident forms app presented on the controlled-environment facility resident communication and/or media device, or in a similar manner. To reduce confusion, and generally facilitate registration of the resident to vote, the controlled-environment facility management system may partially complete the documents required for the resident to register to vote, such as by filling out the name of the resident and identification information of the resident (such as, the social security number, state issued identification number, or the like of the resident), address information, etc. As noted, the address of the controlled-environment facility may be included as the address of the resident, or an address other than the controlled-environment facility may be indicated as the residence address of the resident for purposes of registering to vote (however, the controlled-environment facility may be listed as the mailing address of the resident). Thus, partial completion of documents required for the resident to register to vote (by the controlled-environment facility management system, or the like) may assist in avoiding confusion as to what address the resident/incarcerated individual should fill-in on the forms in various places on the form (such as, residence address, mailing address, permanent address, etc.).

Also, in furtherance of voter registration of the resident, the controlled-environment facility management system, or the like, may enable the resident, such as via the controlled-environment facility resident communication and/or media device, to obtain a form of identification and/or identification information required by law and/or rule to register to vote in the jurisdiction in which the resident is determined to reside. Such identification may include a state identification card, or the like.

As noted above, further identification and verification, such as further submission and verification of a resident's/incarcerated individual's ID number, PIN, biometrics (e.g., facial recognition, fingerprints, finger geometry, iris recognition, vein recognition, retina scanning, voice recognition, or DNA matching) and/or other identifying information may be required for the resident to take certain steps in voting and/or registering to vote in accordance with the present systems and methods. For example, to receive, access, fill out and/or submit the voter registration form provided at 225, for filing at 230 and/or to receive, access, fill out and/or submit the ballot provided at 240, for casting at 245, the resident may be prompted to again provide a resident's/incarcerated individual's ID number, PIN, biometrics (e.g., facial recognition, fingerprints, finger geometry, iris recognition, vein recognition, retina scanning, voice recognition, or DNA matching) or other identifying information.

Where the ballot received at 235 is a paper ballot, embodiments of the present systems and methods may call for the controlled-environment facility management system (125) to, upon receipt of the paper ballot at 235 for the resident to vote, direct delivery of the paper ballot to the resident at 240 and direct casting of the paper ballot at 245, after the paper ballot is executed by the resident, in the resident's jurisdiction of residency, in accordance with the laws and/or rules of the resident's jurisdiction of residency.

However, in accordance with various embodiments of the present systems and methods, the controlled-environment facility management system (125), or the like, may determine if the completed ballot needs to be returned to the resident/incarcerated individual for clarification, signature verification, or the like, the controlled-environment facility management system, or the like may return, or direct return, of the ballot to the resident/incarcerated individual for clarification, signature verification, or the like, or otherwise rectified based on the rules/regulations of the jurisdiction, prior to casting the ballot at 245.

Various elements of the present systems and methods for facilitation and enablement of voting by controlled-environment facility residents, may be implemented as modules. Modules may be implemented in hardware. In another embodiment, modules may be expressed in software executed by hardware. In still another embodiment, modules may be implemented in firmware operated by hardware. In still other embodiments, modules may be implemented in combinations of hardware, software, and/or firmware.

Embodiments of the present systems and methods for enablement of voting by controlled-environment facility residents, as described herein, may be implemented at least in part as, or executed, at least in part, by one or more computer systems. One such computer system is illustrated in FIG. 3. In various embodiments, computer system 300 may be a server, a mainframe computer system, a workstation, a network computer, a desktop computer, a laptop, a tablet computing device, media player, or the like. For example, in some cases, computer 300 may implement one or more steps of example process 200 described above with respect to FIG. 2, and/or a computer system such as computer system 300 may be used as part of, one or more of: controlled environment facility communication processing system 110; controlled-environment facility vendor datacenter 115 elements, such as controlled-environment facility management system 125, and/or the like; controlled-environment facility resident communication and/or media devices 130 or 140; non-resident communications device 160; and/or the like. In various embodiments two or more of these computer systems may be configured to communicate with each other in any suitable way, such as, for example, via public network 120, which may be the Internet, or the like, as discussed above, via a local area network using wired or wireless functionality, etc.

As illustrated, computer system 300 includes one or more processors 310A-N coupled to a system memory 320 via bus 330. Computer system 300 further includes a network interface 340 coupled to bus 330, and one or more I/O controllers 350, which in turn are coupled to peripheral devices such as cursor control device 360, keyboard 370, display(s) 380, etc. Each of I/O devices 360, 370, 380 may be capable of communicating with I/O controllers 350, for example, via a wired connection (e.g., serial port, Universal Serial Bus port) or wireless connection (e.g., Wi-Fi, Bluetooth, Near Field Communications Link, etc.). Other devices may include, for example, microphones, antennas/wireless transducers, phone detection modules, etc.

In various embodiments, computer system 300 may be a single-processor system including one processor 310A, or a multi-processor system including two or more processors 310A-N (e.g., two, four, eight, or another suitable number). Processors 310 may be any processor capable of executing program instructions. For example, in various embodiments, processors 310 may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processors 310 may commonly, but not necessarily, implement the same ISA. Also, in some embodiments, at least one processor 310 may be a graphics processing unit (GPU) or another dedicated graphics-rendering device.

System memory 320 may be configured to store program instructions and/or data accessible by processor 310. In various embodiments, system memory 320 may be implemented using any suitable memory technology, such as static random-access memory (SRAM), synchronous dynamic RAM (SDRAM), nonvolatile/Flash-type memory, or any other type of memory. As illustrated, program instructions and data implementing certain operations and modules such as those described herein may be stored within system memory 320 as program instructions 325 and data storage 335, respectively. In other embodiments, program instructions and/or data may be received, sent, or stored upon different types of computer-accessible media or on similar media separate from system memory 320 or computer system 300.

A computer-accessible medium may include any tangible and/or non-transitory storage media or memory media such as electronic, magnetic, or optical media—e.g., disk or CD/DVD-ROM coupled to computer system 300 via bus 330. The terms "tangible" and "non-transitory," as used herein, are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer-readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

In an embodiment, bus 330 may be configured to coordinate I/O traffic between processor 310, system memory 320, and any peripheral devices in the computer system, including network interface 340 or other peripheral interfaces, such as I/O devices 360, 370, 380. In some embodiments, bus 330 may perform any necessary protocol, timing, or other data transformations to convert data signals from one component (e.g., system memory 320) into a format suitable for use by another component (e.g., processor 310). In some embodiments, bus 330 may include support for devices attached through various types of peripheral buses, such as a variant of the Peripheral Component Interconnect (PCI) bus standard or the Universal Serial Bus (USB) standard, for example. In some embodiments, the function of bus 330 may be split into two or more separate components, such as a northbridge chipset and a southbridge chipset, for example. In addition, in some embodiments some or all the functionality of bus 330, such as an interface to system memory 320, may be incorporated directly into processor(s) 310A-N.

Network interface 340 may be configured to allow data to be exchanged between computer system 300 and other devices attached to a network, such as other computer systems, or between nodes of computer system 300. In various embodiments, network interface 340 may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol.

I/O controllers 350 may, in some embodiments, enable communications with one or more display terminals, keyboards, keypads, touchpads, scanning devices, voice or optical recognition devices, mobile devices, or any other devices suitable for entering or retrieving data by one or more computer system 300. Multiple I/O controllers 350 may be present in computer system 300 or may be distributed on various nodes of computer system 300. In some embodiments, I/O devices may be separate from computer system 300 and may interact with one or more nodes of computer system 300 through a wired or wireless connection, such as over network interface 340.

As shown in FIG. 3, system memory 320 may include program instructions 325, configured to implement certain embodiments described herein, and data storage 335, comprising various data may be accessible by program instructions 325. In an embodiment, program instructions 325 may include software elements, which may be configured to affect the operations discussed in FIGS. 1 and 2. Program instructions 325 may be implemented in various embodiments using any desired programming language, scripting language, or combination of programming languages and/or scripting languages (e.g., C, C++, C#, JAVA®, JAVASCRIPT®, PERL®, etc.). Data storage 335 may include data that may be used in these embodiments (e.g., recorded communications, profiles for different modes of operations, etc.). In other embodiments, other or different software elements and data may be included.

A person of ordinary skill in the art will appreciate that computer system 300 is merely illustrative and is not intended to limit the scope of the disclosure described herein. The computer system and devices may include any combination of hardware or software that can perform the indicated operations. In addition, the operations performed by the illustrated components may, in some embodiments, be performed by fewer components or distributed across additional components. Similarly, in other embodiments, the operations of some of the illustrated components may not be provided and/or other additional operations may be available. Accordingly, systems and methods described herein may be implemented or executed with other computer system configurations.

The various operations described herein, particularly in connection with FIGS. 1 through 3, may be implemented in software executed by processing circuitry, hardware, or a combination thereof. The order in which each operation of a given method is performed may be changed, and various operations may be added, reordered, combined, omitted, modified, etc. It is intended that embodiment(s) described herein embrace all such modifications and changes and, accordingly, the above description should be regarded in an illustrative rather than a restrictive sense.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for enabling voting by a controlled-environment facility resident comprising:

a controlled-environment facility resident communication and/or media device comprising:

at least one device processor; and a device memory coupled to the at least one device processor, the device memory configured to store device program instructions executable by the at least one device processor, the device program instructions executable by the at least one device processor to cause the controlled-environment facility resident communication and/or media device to:

request and accept identification information from a controlled-environment facility resident operating the controlled-environment facility resident communication and/or media device; and verify, in conjunction with at least a controlled-environment facility management system associated with a controlled-environment facility housing the resident, the identification information;

the controlled-environment facility management system comprising:

at least one system processor; and a system memory coupled to the at least one processor, the system memory configured to store system program instructions executable by the at least one system processor, the system program instructions executable by the at least one system processor to cause the controlled-environment facility management system to:

determine federal, state and/or local laws and/or rules concerning the resident's legal right to vote;

determine whether the resident is registered to vote in a jurisdiction in which the resident is deemed to reside, with respect to the resident's right to vote in the jurisdiction;

provide in response to a determination that the resident is not registered to vote in the jurisdiction in which the resident is deemed to reside, documents required for the resident to register to vote, to the resident, for completion and/or execution; and file, in the jurisdiction in which the resident is deemed to reside, in response to a determination that the resident is not registered to vote in the jurisdiction in which the resident is deemed to reside, resident-executed documents required for the resident to register to vote.

2. The system of claim 1, wherein:

execution of the system program instructions further cause the controlled-environment facility management system to:

receive an electronic ballot for the resident to vote;

deliver the electronic ballot to the resident, via the controlled-environment facility resident communication and/or media device, for voting; and execution of the device program instructions further cause the controlled-environment facility resident communication and/or media device to:

present the electronic ballot to the resident for voting; and electronically cast the ballot, after the ballot is executed by the resident, to the resident's jurisdiction of residency, in accordance with the laws and/or rules of the resident's jurisdiction of residency.

3. The system of claim 1, wherein, upon receipt of a paper ballot for the resident to vote, execution of the system program instructions further cause the controlled-environment facility management system to direct delivery of the paper ballot to the resident and direct casting of the paper ballot, after the paper ballot is executed by the resident, in the resident's jurisdiction of residency, in accordance with the laws and/or rules of the resident's jurisdiction of residency.

4. The system of claim 1, wherein execution of the system program instructions further cause the controlled-environment facility management system to request, in response to the determination that the resident is not registered to vote in the jurisdiction in which the resident is deemed to reside, the documents required for the resident to register to vote from the jurisdiction in which the resident is deemed to reside.

5. The system of claim 4, wherein the controlled-environment facility management system requests the documents required for the resident to register to vote electronically.

6. The system of claim 1, wherein the documents required for the resident to register to vote are provided to the resident, by the controlled-environment facility management system, electronically, via the controlled-environment facility resident communication and/or media device.

7. The system of claim 1, wherein execution of the system program instructions further cause the controlled-environment facility management system to at least partially complete the documents required for the resident to register to vote to include at least the address of the controlled-environment facility as the address of the resident.

8. The system of claim 1, wherein execution of the system program instructions further cause the controlled-environment facility management system to at least partially complete the documents required for the resident to register to vote to include at least the name of the resident and any required identification information.

9. The system of claim 1, wherein execution of the system program instructions further cause the controlled-environment facility management system to enable the resident, via at least the controlled-environment facility resident communication and/or media device to obtain a form of identification and/or identification information required by law and/or rules to register to vote in the jurisdiction in which the resident is determined to reside.

10. The system of claim 1, wherein the controlled-environment facility is a correctional facility, the resident is an incarcerated individual of the correctional facility, and the federal, state and/or local laws and/or rules concerning the resident's legal right to vote pertain to the rights of incarcerated individuals to vote.

11. A method for enabling voting by controlled-environment facility residents:

requesting and accepting, by a controlled-environment facility resident communication and/or media device, identification information from a controlled-environment facility resident operating the controlled-environment facility resident communication and/or media device;

verifying, by a controlled-environment facility management system associated with a controlled-environment facility housing the resident, the identification information;

determining, by the controlled-environment facility management system, federal state and/or local laws and/or rules concerning the resident's legal right to vote;

determining, by the controlled-environment facility management system, whether the resident is registered to vote in a jurisdiction in which the resident is deemed to reside, with respect to the resident's right to vote in the jurisdiction;

providing, by the controlled-environment facility management system, in response to a determination that the resident is not registered to vote in the jurisdiction in which the resident is deemed to reside, documents required for the resident to register to vote, to the resident, for completion and/or execution;

filing in the jurisdiction in which the resident is deemed to reside, by the controlled-environment facility management system, in response to a determination that the resident is not registered to vote in the jurisdiction in which the resident is deemed to reside, resident-executed documents required for the resident to register to vote;

receiving, by the controlled-environment facility, a ballot for the resident to vote;

providing, by the controlled-environment facility, the ballot to the resident for voting; and casting, by the controlled-environment facility, the ballot, after the ballot is executed by the resident's jurisdiction of residency, in accordance with the laws and/or rules of the resident's jurisdiction of residency.

12. The method of claim 11, wherein determining federal state and/or local laws and/or rules concerning the particular resident's right to vote comprises:

determining residency of the resident, with respect to any existing legal right by the resident's right to vote in a jurisdiction in which the controlled-environment facility exists; and determining residency of the resident, with respect to any right by the resident's right to vote in a jurisdiction other than the jurisdiction in which the controlled-environment facility exists.

13. The method of claim 11, further comprising requesting, by the controlled-environment facility management system, in response to the determination that the resident is not registered to vote in the jurisdiction in which the resident is deemed to reside, the documents required for the resident to register to vote.

14. The method of claim 13, wherein the documents required for the resident to register to vote are provided to the resident electronically.

15. The method of claim 11, wherein filed resident-executed documents required for the resident to register to vote lists an address of the controlled-environment facility as the address of the resident.

16. The method of claim 15, wherein the controlled-environment facility management system partially completes the documents required for the resident to register to vote to include at least the address of the controlled-environment facility as the address of the resident.

17. The method of claim 11, wherein the controlled-environment facility management system partially completes the documents required for the resident to register to vote to include at least the name of the resident and any required identification information.

18. The method of claim 11, further comprising enabling the resident to obtain a form of identification and/or identification information required by law and/or rules to register to vote in the jurisdiction in which the resident is determined to reside.

19. The method of claim 11, wherein the ballot is received and/or cast electronically.

20. The method of claim 11, wherein the ballot is a paper ballot.

21. The method of claim 11, wherein the controlled-environment facility is a correctional facility, the resident is an incarcerated individual of the correctional facility, and the federal state and/or local laws and/or rules concerning the resident's legal right to vote pertain to the rights of incarcerated individuals to vote.

* * * * *